US005536000A

United States Patent [19]

Kelly

[11] Patent Number: 5,536,000

[45] Date of Patent: Jul. 16, 1996

[54] ADJUSTABLE SHEET MEDIA HANDLING SYSTEM WITH ACTIVE SHEET MEDIA DROP

[75] Inventor: Kieran B. Kelly, Vancouver, Wash.

[73] Assignee: Hewlett-Packard Company, Palo Alto, Calif.

[21] Appl. No.: 380,179

[22] Filed: Jan. 30, 1995

[51] Int. Cl.[6] ..... B65H 29/34

[52] U.S. Cl. ..... 271/189; 271/213; 271/223

[58] Field of Search ..... 271/189, 213, 271/220, 223; 101/419, 420, 485; 400/625

[56] References Cited

U.S. PATENT DOCUMENTS

| | | | |
|---|---|---|---|
| 4,728,963 | 3/1988 | Rasmussen et al. | 346/25 |
| 4,794,859 | 1/1989 | Huseby et al. | 101/485 |
| 4,844,633 | 7/1989 | Greenberg | 101/419 |
| 5,031,894 | 7/1991 | Bedzyk et al. | 271/240 |
| 5,188,351 | 2/1993 | Gysling . | |
| 5,226,743 | 7/1993 | Jackson et al. | 400/625 |
| 5,244,294 | 9/1993 | Ewing | 400/625 |
| 5,269,613 | 12/1993 | Olson et al. . | |
| 5,286,018 | 2/1994 | Rasmussen et al. . | |
| 5,366,216 | 11/1994 | Ahlvin | 271/171 |
| 5,377,966 | 1/1995 | Ohmori | 271/3 |
| 5,411,252 | 5/1995 | Lowell | 271/223 |
| 5,419,548 | 5/1995 | Ueda et al. | 271/294 |
| 5,434,660 | 7/1995 | Yoshida et al. | 355/309 |

FOREIGN PATENT DOCUMENTS

| | | | |
|---|---|---|---|
| 1077232 | 3/1960 | Germany | 271/189 |
| 1419508 | 12/1975 | United Kingdom . | |

OTHER PUBLICATIONS

GPM-3 facsimile inkjet printing mechanism manuractured by Hewlett-packard Co., Palo Alto, CA, first offset for sale to OEM manufacturers in Jul. 1993.

*Primary Examiner*—Karen B. Merritt
*Assistant Examiner*—Douglas Hess

[57] ABSTRACT

A sheet media handling system is provided for use in a sheet processor, such system incorporating a pair of pivotal rail members which adjust laterally to afford support of variously-sized sheets. The system employs both input and output support structures, the input support structure including a pair of relatively movable side walls which adjust to accommodate sheets of different size. The rail members are linked by cooperative camming engagement with an elongate linkage arm which extends between the rail members to ensure simultaneous pivot of the rail members between respective sheet-supporting and sheet-releasing positions.

20 Claims, 2 Drawing Sheets

ADJUSTABLE SHEET MEDIA HANDLING SYSTEM WITH ACTIVE SHEET MEDIA DROP

TECHNICAL FIELD

The present invention relates generally to sheet media handling, and more particularly, to a system with support structure which adjusts to provide for the handling of variously-sized sheets. Although the invention has broad utility, it has proven particularly well-suited for use in an ink-jet printer where sheets of different size are to be input, printed on, and expelled.

BACKGROUND ART

In a conventional ink-jet printer, sheets are directed through a print cycle which includes picking up a sheet from an input tray, feeding it through a printing zone for printing, and then expelling it through an output port. Once expelled, sheets fall to an output tray, consecutive sheets piling one on top of the other so as to form an output stack. Because ink-jet printers print using wet ink, and because sheets often are stacked immediately after printing, ink-jet printers have in the past experienced some difficulty with blotting and/or smearing of ink upon contact between consecutively printed sheets. This has been particularly apparent where ink drying time exceeds the time between printing of consecutive sheets. Although a variety of solutions have been proposed to deal with this problem, none have provided adequate ink drying time without some cost to the printer's efficiency, versatility or size.

Some manufactures have, for example, attempted to eliminate ink smearing and blotting problems by decreasing ink drying time. Manufacturers thus have employed quick-drying ink, or specially-coated paper, often resulting in poorer quality print. Manufacturers also have sought to provide some sort of drying lamp or heater adjacent the printed media, thus adding to the complexity of the printer, and consequently adding to the printer's price.

Other manufacturers have attempted to delay the deposit of printed sheets in the output tray so as to provide the previously-printed sheet with adequate drying time. The most basic of such solutions have involved simply slowing printer throughput by creating an artificial time delay between printing of consecutive sheets. Although this solution does increase the time available for ink to dry, it has proven unacceptable in view of the ever-increasing desire to improve printer efficiency and speed.

Another solution proposed by printer manufacturers has been to employ a passive sheet media drop scheme whereby a sheet emerging from the printer's output port is guided along rails which temporarily support the sheet above the output tray. Upon completion of printing, the sheet simply drops under its own weight into the output tray, the previously-printed sheet having had ample opportunity to dry during printing of the present sheet. However, such passive drop schemes are not always reliable due to a phenomenon known as cockling, an effect which may result in undulation of a printed sheet due to environmental extremes or large amounts of ink on the sheet. As a result of such cockling, sheets do not always drop into the output tray after printing, but instead are pushed forward and out of the printer by the following sheet.

Yet another solution has involved the use of an active sheet media drop mechanism wherein a printed sheet is guided along a pair of movable rails which temporarily support the sheet above the printer's output tray while the previously printed sheet drys. Once printing is completed, the rails retract, often pivotally, allowing the sheet to fall to an output tray below. One such active drop mechanism is described in U.S. Pat. No. 4,794,859 to Huseby et al., which is entitled "Active Paper Drop for Printers", and which is commonly owned herewith. The disclosure of that patent is incorporated herein by this reference.

Although generally effective, active drop mechanisms generally have presented problems in known sheet media handling systems due to difficulties associated with the support of sheets of different size. Because of the different sheet sizes, rails have in the past been made relatively wide such that rails of a fixed dimension could support variously-sized sheets. This wide rail design, in turn, has increased printer chassis size, and has required an unnecessarily large amount of raw material to manufacture the chassis and rails. Use of wide rails also has led to increased sheet sail, due in part to the wider sweep of such rails when an expelled sheet is released. The present invention provides an improved sheet media handling system which affords active release of variously-sized sheets without unduly increasing the system's size, complexity or price.

DISCLOSURE OF THE INVENTION

In accordance with the present invention, a sheet media handling system is provided for use in a sheet processor, such system incorporating a pair of pivotal rail members which adjust laterally to afford support of variously-sized sheets. The system employs both input and output support structures, the input support structure including a pair of relatively movable side walls which adjust to accommodate sheets of different size. Each rail member is pivotally mounted on one of the side walls, the rail members being configured to pivot cooperatively between a closed orientation wherein the rail members support a sheet, and an open orientation wherein the rail members release the sheet.

The rail members are linked via camming engagement with an elongate linkage arm which extends between the rail members to ensure simultaneous rail member pivot between their respective sheet-supporting and sheet-releasing positions. When a first rail member is pivoted, the linkage arm is cammingly moved, resulting in corresponding pivot of a second rail member. At least one of the rail members is laterally movable along the linkage arm without interfering with the camming relationship therebetween.

Rail member action is directed by a sheet advancement mechanism, such mechanism employing a pivot assembly which cammingly engages the first rail member once a sheet has been expelled. The pivot assembly cammingly engages only the first rail member, and engages such rail member at a location which is outside of the sheet media path. The system thus allows for variously-sized single sheets to be loaded and processed through a single sheet input slot regardless of the configuration of the input or output support structures. The present invention thus provides for versatile sheet processing using a sheet media handling system which is low in cost.

These and other objects and advantages of the present invention will be more readily understood after a consideration of the drawings and the detailed description of the preferred embodiment which follows.

DETAILED DESCRIPTION OF THE PREFERRED EMBODIMENT AND BEST MODE FOR CARRYING OUT THE INVENTION

Figure 1:
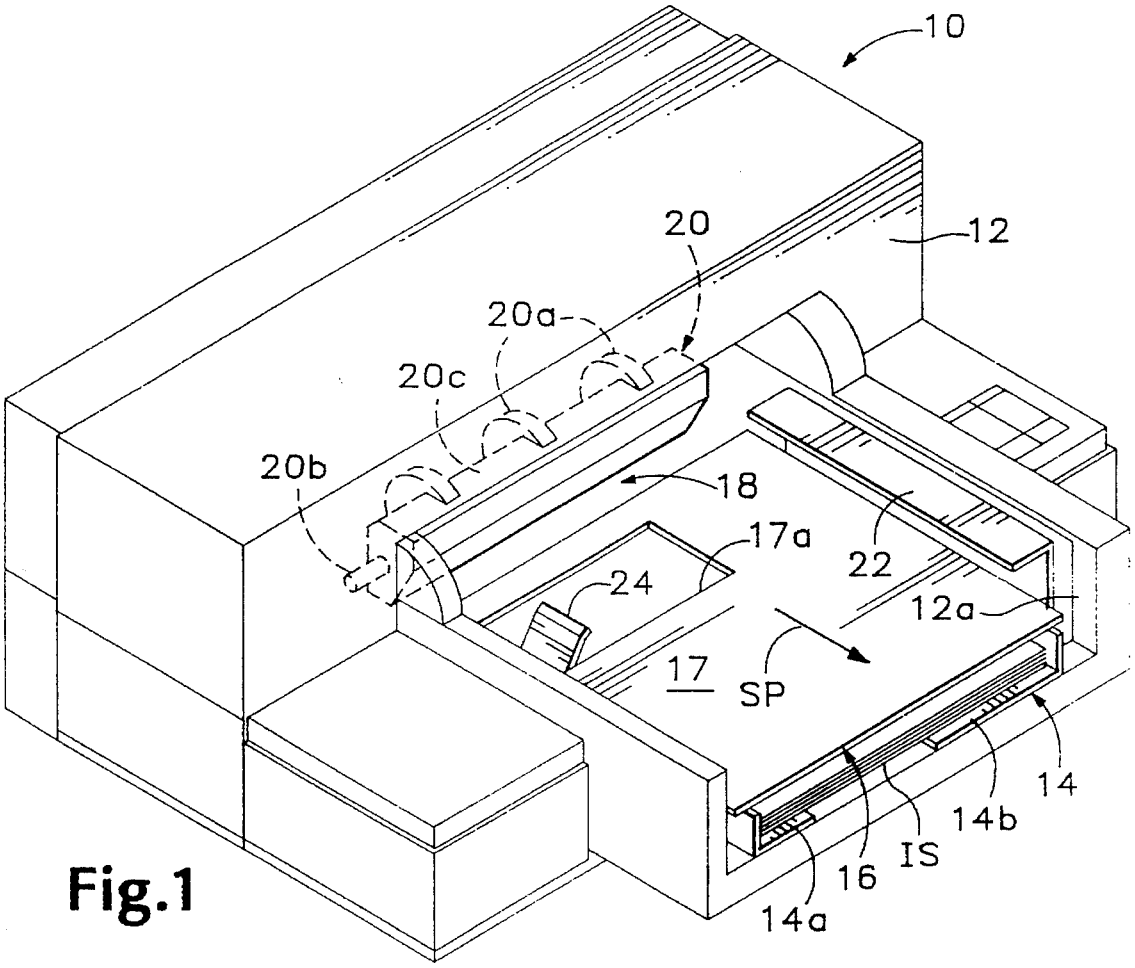
FIG. 1 is an isometric view of a single-sheet ink-jet printer, such printer incorporating an adjustable sheet media handling system constructed in accordance with a preferred embodiment of the present invention.

FIG. 1 shows a sheet processor in the form of a somewhat typical single-sheet ink-jet printer 10, such printer including a chassis 12 which houses an input tray 14 and an output tray 16. As indicated, the input tray acts as an input support structure, supporting a sheet media input stack IS on a pair of relatively adjustable input tray floor sections 14*a*, 14*b* for delivery to the printer through an input port (not shown). The output tray acts as the printer's output support structure, employing a generally horizontal output tray floor 17 which holds sheets once they have been expelled through the printer's output port.

As is conventional, the input and output trays are configured to handle uniformly-sized sheets, the input tray generally being adjustable to maintain alignment of sheets in the input stack. The output tray is similarly adjustable, such adjustment preferably occurring coincidentally with adjustment of the input tray. It will be noted, however, that the depicted printer also is provided with a single-sheet input slot 18 which allows for the input of variously-sized sheets individually, regardless of the configuration of the input or output trays. The single-sheet input slot provides access to the printer's input port through an unobstructed slot which extends through the output tray floor and into the input port.

Sheets are directed through the printer using a sheet advancement mechanism 20, such mechanism generally employing a plurality of rollers 20*a* mounted on a driven shaft 20*b*. A pivot assembly 20*c* also is employed to direct the flow of sheets. Sheets generally are pulled consecutively from the input stack, passed downstream to the printer's print zone, and subsequently, passed along a generally horizontal outflow path (or axis) SP for stacking in the output tray (see FIGS. 3 and 4).

In accordance with one important feature of the invention, printer 10 is provided with an active drop mechanism, such mechanism being configurable to support a printed sheet above the output tray while ink on a preceding sheet is afforded time to dry. Once the ink has dried, the sheet is released, and falls to the output tray below. Sheet release preferably will correspond closely with completion of the printing operation, thus avoiding ink smearing or blotting without undue delay to printer throughput.

Figure 2:
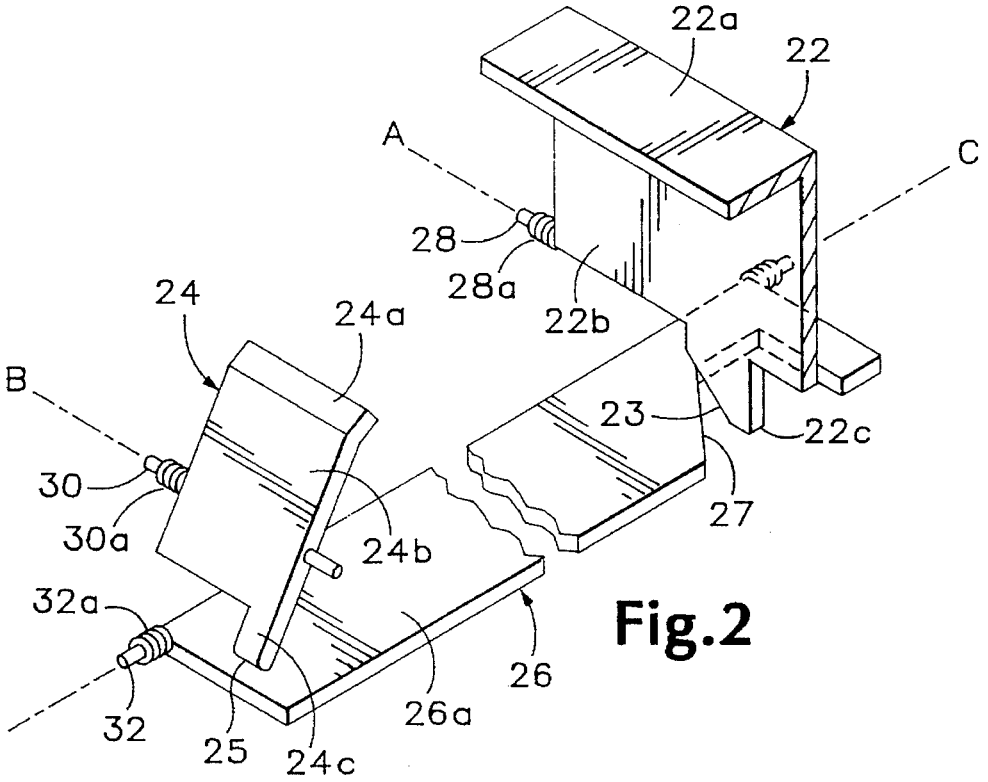
FIG. 2 is an enlarged, fragmentary, isometric view of an active drop mechanism which forms a part of the sheet media handling system depicted in FIG. 1.

As indicated in FIGS. 1 and 2, the active drop mechanism of the present invention includes a pair of opposed, spaced-apart rail members 22, 24, such rail members being configurable in a closed orientation to support opposite side edges of an expelled sheet. First rail member 22 extends along the right edge (as viewed in FIG. 1) of the output tray to support a right-side edge of an expelled sheet. Second rail member 24 extends through an opening 17*a* in the output tray floor to support a left-side edge of the expelled sheet. Each rail member is mounted on a side wall of the input tray, at least one of such side walls being laterally adjustable to accommodate variously-sized sheets as will be described below.

Once printing is completed, the rail members pivot oppositely to an open orientation (see FIG. 4) where the expelled sheet is released to the output tray. First rail member 22 pivots about a first rail member axis A which extends along the length of the first rail member. Second rail member 24 pivots about a second rail member axis B which extends similarly along the length of the second rail member. Both rail member axes extend substantially parallel to the path of sheet media outflow SP.

Referring now to FIGS. 2 through 5 generally, it will be noted that each rail member includes an elongate sheet-supporting surface 22*a*, 24*a*, such surfaces being configurable to support an expelled sheet above the floor of the output tray. In the depicted embodiment, the sheet-supporting surfaces are defined atop corresponding upright wall sections 22*b*, 24*b*, each such wall section acting as a side wall of the output tray. The rail member axes extend through the wall sections, affording pivotal release of the expelled sheet. The rail members thus may be considered to pivot between respective sheet-supporting and sheet-releasing positions.

In accordance with my teachings, the rail members are cooperatively related, each including a cam section 22*c*, 24*c* which projects downwardly from the wall sections to cammingly engage an elongate linkage arm 26. The linkage arm extends between the rail members, preferably in an area beneath the input and output trays so as to engage the cam sections without obstructing passage of sheets. The linkage arm pivots about a linkage arm axis C which extends laterally between the rail members to provide a complimentary relationship therebetween.

Cam section 22*c* defines a first cam surface 23 which engages a corresponding cam surface 27 of linkage arm 26. In the depicted embodiment, cam surface 27 is defined by a notch which receives cam section 22*c* to provide for predefined camming engagement between rail member 22 and linkage arm 26. Rail member 24 defines a second cam surface 25 which engages upper surface 26*a* of the linkage arm. Upper surface 26*a*, it will be noted, is defined by an elongate, generally planar flap which extends along a substantial portion of the linkage arm. Pivot of first rail member 22 thus directs pivot the linkage arm, and correspondingly, directs pivot of the second rail member 24.

The rail members and linkage arm pivot on elongate rods 28, 30, 32, each extending along a corresponding pivot axis A, B, C, respectively. A bias element 28*a* urges first rail member 22 toward the sheet-supporting position, pivot of the first rail member generally being limited by engagement between a rail member tab 22*d* and a pivot assembly tab 20*d* which forms a part of pivot assembly 20*c*. A bias element 30*a* urges second rail member 24 toward the sheet-releasing position, pivot of the second rail member being limited by camming engagement with the linkage arm. A bias element 32*a* urges linkage arm 26 toward the orientation shown in FIGS. 2 and 3, effectively urging the rail members into their sheet-supporting positions. Bias elements 28*a* and 32*a* thus act together to nominally overcome the lesser force exerted by bias element 30*a*. Those skilled will, in fact, appreciate that bias element 28*a* may be unnecessary where bias element 32*a* is sufficiently powerful to overcome the force exerted by bias element 30*a*.

Figure 3:
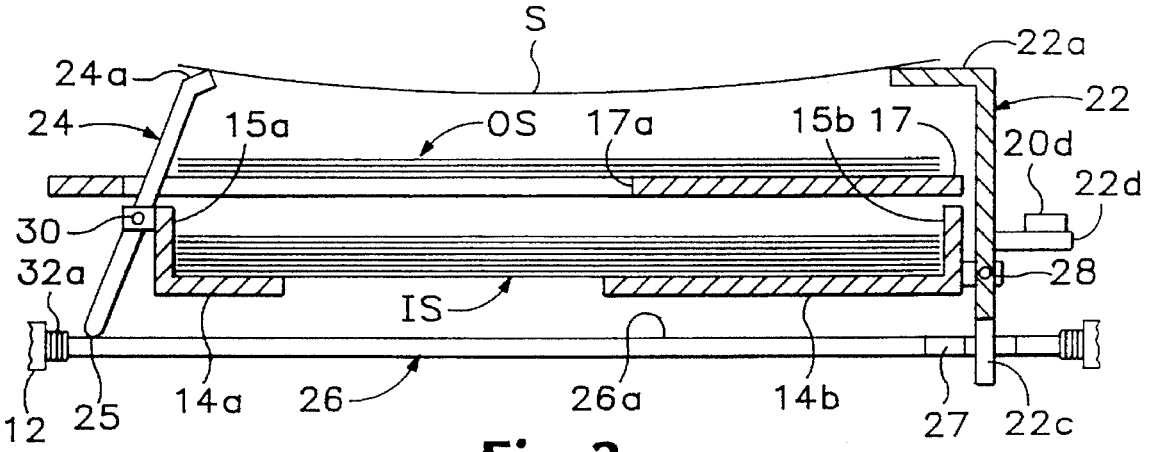
FIG. 3 is an enlarged front sectional view of the sheet media handling system depicted in FIG. 1, the system being configured to support an expelled sheet above the printer's output stack.
Figure 4:
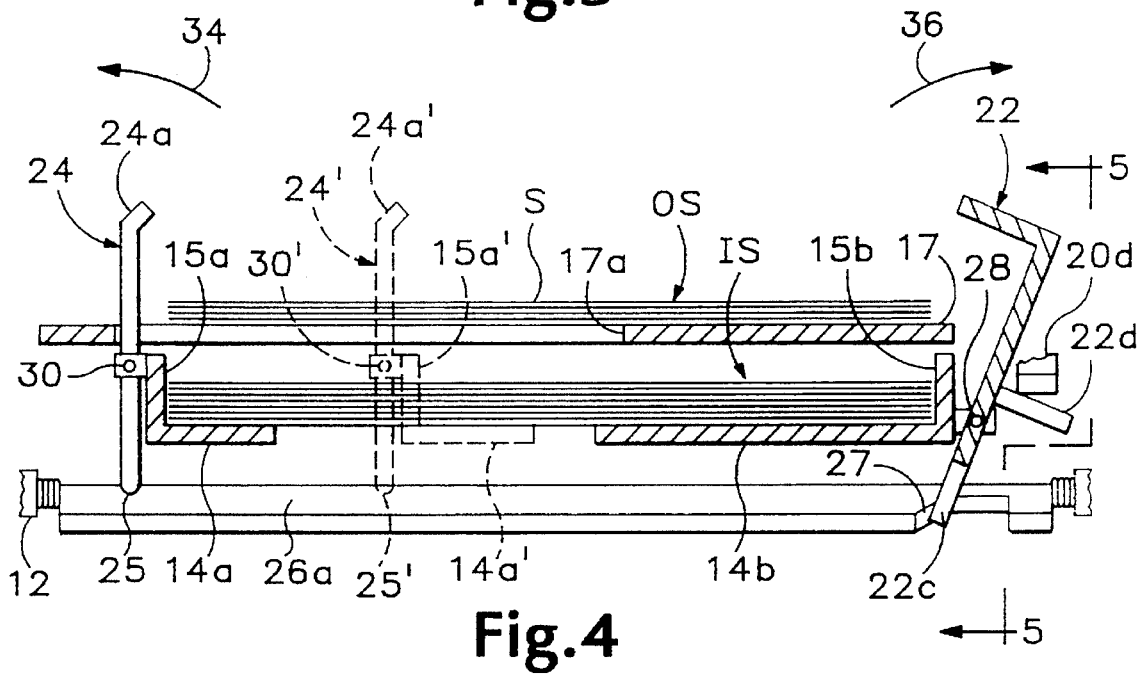
FIG. 4 is a view similar to that of FIG. 3, but with the system configured to release the sheet to the output stack.
Figure 5:
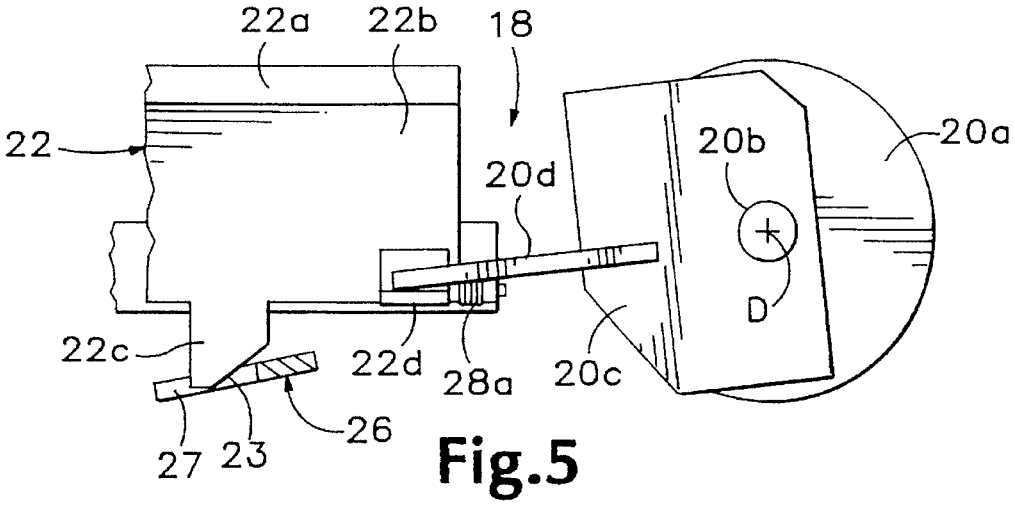
FIG. 5 is a fragmentary side sectional view of the depicted sheet media handling system, such view being taken generally along lines 5—5 of FIG. 4.

Focussing now on FIGS. 3 through 5, operation of the invented system is illustrated, such system being configurable to temporarily support a printed sheet S above an output stack OS. During sheet expulsion, the rail members 22, 24 are in a closed orientation (FIG. 3), each rail member being configured to support a side edge of the sheet as previously described. The rail members are yieldably urged into this closed orientation by linkage arm 26, generally due to a force exerted by bias element 32*a*—rail member 22 is urged into position by bias element 28*a*.

Once the sheet has been completely expelled, pivot assembly 20*c* is turned (about an axis D), effecting camming engagement between pivot assembly tab 20*d* and corresponding rail member tab 22*d* (see FIGS. 4 and 5). The tabs engage one another in an area outside (to the right in FIG. 4) of the vertically stacked input and output trays, ensuring unobstructed passage of sheets through single sheet input slot 18, and through the printers input and output ports. The pivot assembly thus directs pivot of first rail member 22 in the direction indicated by arrow 36 in FIG. 4. The first rail member is pivoted despite the effect of the bias elements, the force exerted by the pivot assembly exceeding that of bias elements 28*a*, 32*a*.

Upon pivot of first rail member 22, the first rail member's cam surface 23 will engage the linkage arm's cam surface 27, pivoting the linkage arm. The linkage arm, it will be noted, pivots about an axis C which is perpendicular to rail member axes A, B, due in part to the angular relationship between cam surfaces 23 and 27. As the linkage arm pivots, the second rail member will pivot in the direction indicated by arrow 34, generally under a force exerted by bias element 30*a*. As the linkage arm pivots, linkage arm surface 26*a* will move away from cam surface 25, effectively moving the limiting opposition to pivot of the second rail member.

Pivot assembly 20*c* thus effectively controls the pivot of both rail members, simultaneously moving the rail members to either the open or closed orientation. Sheet S thus may be released by action of the pivot assembly, the sheet being allowed to fall to the output stack as shown in FIG. 4. During sheet release, the printer's chassis may act as a sheet stripper, preferably by contact between the sheet and a chassis side wall 12*a*.

At least one of the rail members is laterally movable, preferably in connection with adjustment of the input tray size. In the depicted embodiment, the input tray is defined by relatively movable floor sections 14*a*, 14*b* and corresponding side walls 15*a*, 15*b*. Lateral rail member movement thus is readily achieved by mounting the rail members on the input tray side walls. The first rail member 22 is mounted on the outside of the input tray's right side wall 15*b* (as viewed in FIG. 4). The second rail member is mounted on the outside of the input tray's left side wall (also as viewed in FIG. 4). Lateral movement of the side walls thus effects corresponding lateral movement of the rail members, and of the sheet-supporting surfaces which form a part thereof.

In the depicted embodiment, the input tray's right side wall 15*b* is laterally fixed, providing for right-justified input of sheets. Left side wall 15*a*, however, adjusts laterally via a track (not shown) so as to accommodate input of variously-sized sheets. The left side wall may, for example, adjust in the manner shown and described in U.S. patent application Ser. No. 08/311,084 which is entitled "Sheet Media Handling System with Interrelated Input Alignment and Output Support", and which is commonly owned herewith. The disclosure of that application is incorporated herein by this reference.

Because the second rail is mounted on the left side wall, it will be understood that the second rail member will adjust laterally with the left side wall. Such adjustment is illustrated in FIG. 4, the adjusted left floor section 14*a*', left side wall 15*a*' and second rail member 24' being shown in dashed lines. The input tray's left floor section 14*a*' and left side wall 15*a*', it will be noted, have been adjusted to accommodate input of sheets which are smaller than those shown. Rail member 24' thus has been adjusted correspondingly within opening 17*a* to accommodate support and release of the smaller sheets by sheet-supporting surface 24*a*'. Rail member 24' is shown in its sheet-releasing position, the rail member having been pivoted about rod 30'.

Upon further review of FIG. 4, it will be appreciated that, because the upper surface of the linkage arm flap extends along the length of the linkage arm in a plane, the second rail member may be moved laterally without changing the camming relationship between the linkage arm and the second rail member. The second rail member's cam surface thus continues to contact the linkage arm's upper surface despite lateral repositioning of the second rail member as shown at 25'. This allows for automatic adaptability of the active drop mechanism upon lateral adjustment of the input tray.

INDUSTRIAL APPLICABILITY

Although particularly well-suited for used for a single-sheet, ink-jet printer, the above-described sheet media handling system is useful in virtually any sheet processor wherein sheets are to be supported. The system is especially effective in sheet processors wherein variously-sized sheets are to be supported, due in part to the adaptability of the system's active drop mechanism.

While the present invention has been shown and described with reference to the foregoing operational principles and preferred embodiment, it will be apparent that to those skilled in the art that various changes in form and detail may be made without departing from the spirit and scope of the invention as defined by the appended claims.

I claim:

1. A sheet media handling system for use in a sheet processor which expels sheets along an outflow axis, said handling system comprising:

an output support structure including a pair of opposed rail members which are movable between a closed orientation wherein said rail members support opposite side edges of an expelled sheet and an open orientation wherein said rail members release the expelled sheet; and an elongate linkage arm which is configured to engage each of said rail members by separate cam members such that a first rail member moves to engage said linkage arm, by a first cam member, to effect movement of said linkage arm, and said linkage arm engages a second rail member, by a second cam member, to provide for corresponding movement of said second rail member.

2. The handling system of claim 1, wherein said output support structure further includes a generally horizontal output tray floor which supports sheets upon release from said rail members.

3. The handling system of claim 2, wherein said linkage arm extends between said rail members in an area beneath said output tray floor.

4. The handling system of claim 2, wherein each rail member extends generally upwardly from said output tray floor, at least one of said rail members being movable laterally relative to the outflow axis to accommodate support of different size sheets.

5. The handling system of claim 1, wherein each rail member is pivotally movable between an open position and a closed position.

6. The handling system of claim 5, wherein said output support structure includes a first bias element which yieldably urges said first rail member into said closed position.

7. The handling system of claim 6, wherein said linkage arm is pivotally movable about a linkage arm axis which extends laterally between said rail members to selectively support said second rail member in said closed position.

8. The handling system of claim 7, wherein said linkage arm is notched to provide for predefined engagement between said first rail member and said linkage arm upon pivotal movement of said first rail member, said first rail member thereby directing pivotal movement of said linkage arm.

9. The handling system of claim 8, wherein said linkage arm defines a generally planar flap which extends along a substantial portion of said linkage arm, said flap being configured to engage said second rail member upon pivot of said linkage arm to direct pivotal movement of said second arm member between said open and closed positions.

10. The handling system of claim 9, wherein said second rail member is movable laterally relative to the outflow axis to accommodate support of different size sheets, said flap having a length which provides for similar engagement between said linkage arm and said second rail member in various lateral positions of said second rail member.

11. A sheet media handling system for use in a sheet processor which expels sheets along an outflow path, said handling system comprising:

an input support structure including an input tray floor and a pair of relatively movable side walls configured to define an input tray which supports sheet media prior to input;

an output support structure including an output tray floor and a pair of spaced-apart rail members configured for movement with said side walls to support expelled sheets above said output tray floor, each rail member being pivotally mounted on a corresponding one of said side walls for pivot between a sheet-supporting position wherein said rail members support an expelled sheet above said output tray floor and a sheet-releasing position wherein said rail members release the expelled sheets; and an elongate linkage arm which extends between said rail members to cooperatively relate said rail members, said linkage arm being configured to move upon selected pivot of a first rail member, by a first cam member, to effect pivot of a second rail member by a second cam member.

12. The handling system of claim 11, wherein said linkage arm extends between said rail members in an area beneath said input tray floor.

13. The handling system of claim 12, wherein said input tray floor and said output tray floor are vertically stacked.

14. The handling system of claim 11, which further comprises a sheet-directing pivot assembly which is movable to engage said first rail member to pivot said first rail member between the sheet-supporting and sheet-releasing positions.

15. The handling system of claim 14, wherein said first rail member is movable by said pivot assembly to engage said linkage arm.

16. The handling system of claim 15, wherein said linkage arm is pivotally movable about a linkage arm axis which extends laterally between said rail members.

17. The handling system of claim 16, wherein said linkage arm is pivotally movable by engagement with said first rail member, said linkage arm being configured to engage said second rail member to move said second rail member between the sheet-supporting and sheet-releasing positions.

18. The handling system of claim 11, which further comprises a first bias element which urges said linkage arm toward engagement with said rail members to correspondingly urge said rail members toward the sheet-supporting positions.

19. The handling system of claim 18, further comprising a bias element which yieldably urges said second rail member toward the sheet-releasing position.

20. A sheet media handling system for use in a sheet processor said handling system comprising:

an input support structure including an input tray floor and a pair of relatively laterally movable side walls configured to define an input tray which supports sheets prior to input;

an output support structure including an output tray floor with a single-sheet input slot and a pair of spaced-apart rail members configured for lateral movement with said side walls, each rail member being pivotally mounted on a corresponding one of said side walls for pivotal movement between a sheet-supporting position wherein said rail members support an expelled sheet above said output tray floor and a sheet-releasing position wherein said rail members release the expelled sheets to pass the sheet to said output tray floor;

a sheet-directing pivot assembly including a tab which is pivotally movable to engage a first rail member to pivot said first rail member selectively between the sheet-supporting and sheet-releasing positions without obstructing said single-sheet input slot; and an elongate linkage arm which extends between said rail members to cooperatively relate said rail members, said first rail member engaging said linkage arm by a first cam member upon selected pivotal movement of said pivot assembly, said linkage arm pivoting about a lateral linkage arm axis to engage a second rail member by a second cam member and thus to direct pivot of said second rail member without obstructing said single-sheet input slot.

* * * * *